US012766391B2

(12) United States Patent
Milan

(10) Patent No.: US 12,766,391 B2
(45) Date of Patent: Oct. 20, 2026

(54) TRAINING BAT APPARATUS

(71) Applicant: Ricky Milan, Show Low, AZ (US)

(72) Inventor: Ricky Milan, Show Low, AZ (US)

( * ) Notice: Subject to any disclaimer, the term of this patent is extended or adjusted under 35 U.S.C. 154(b) by 495 days.

(21) Appl. No.: 18/226,407

(22) Filed: Jul. 26, 2023

(65) Prior Publication Data

US 2025/0032876 A1 Jan. 30, 2025

(51) Int. Cl.
*A63B 69/00* (2006.01)
*A63B 59/00* (2015.01)
*A63B 59/50* (2015.01)

(52) U.S. Cl.
CPC ..... *A63B 69/0002* (2013.01); *A63B 59/50* (2015.10); *A63B 2069/0008* (2013.01)

(58) Field of Classification Search
CPC ..... A63B 69/0002; A63B 59/50; A63B 2069/0008
USPC ..... 473/457
See application file for complete search history.

(56) References Cited

U.S. PATENT DOCUMENTS 4,511,139 A 4/1985 Armstrong
5,338,035 A * 8/1994 Lyford ..... A63B 69/3632 473/232
5,516,097 A 5/1996 Huddleston
6,257,992 B1 * 7/2001 LeBlanc ..... A63B 60/00 473/316
6,558,267 B2 5/2003 Novosel, Sr.
6,569,042 B2 5/2003 LaChance
D784,467 S 4/2017 Hess
9,782,655 B1 * 10/2017 Novosel, Sr. ..... A63B 71/0622 473/422
2004/0162167 A1 * 8/2004 Stevens ..... A63B 21/0608 473/457
2006/0199678 A1 9/2006 Benassi
2012/0157240 A1 6/2012 Morris
2016/0096092 A1 * 4/2016 Williams ..... A63B 65/122 473/564
2025/0032876 A1 * 1/2025 Milan ..... A63B 59/50 473/457

FOREIGN PATENT DOCUMENTS

WO WO2017129591 8/2017

* cited by examiner

*Primary Examiner* — Mitra Aryanpour

(57) ABSTRACT

A training bat apparatus for training a user to swing a baseball bat with proper form includes a handle and a barrel, each of which is elongated. The handle extends through an opening into a cavity positioned at an end of the barrel, and the barrel is pivotally coupled to the handle such that the barrel is pivotable around a pivot axis extending perpendicularly through each of the barrel and the handle.

10 Claims, 6 Drawing Sheets

TRAINING BAT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to training bat apparatus and more particularly pertains to a new training bat apparatus for training a user to swing a baseball bat with proper form.

(2) Description of Related Art Including Information Disclosed Under 37 CFR 1.97 and 1.98

The prior art discloses several apparatuses comprising a pair of pivotably interconnected elongate members which may be used to train a user to swing a baseball bat with proper form. However, the prior art fails to comprise a barrel with a cavity through which a handle extends, wherein the barrel is pivotable with respect to the handle around a pivot axis extending perpendicularly. Such an arrangement is advantageous over the prior art because it facilitates shaping the apparatus similar to a standard baseball bat and allows for shaping a rim of the barrel defining an opening to the cavity such that a range of motion of the barrel with respect to the handle is limited as desired.

BRIEF SUMMARY OF THE INVENTION

An embodiment of the disclosure meets the needs presented above by generally comprising a handle is elongated between a first end and a second end. A barrel is pivotally mounted adjacent to the second end of the handle and is elongated between a proximal end and a distal end of the barrel with respect to the handle. The barrel has a cavity extending therein through the proximal end and has a rim defining an opening to the cavity. The handle extends through the opening into the cavity. The barrel is pivotable around a pivot axis extending through and perpendicularly to each of the barrel and the handle. The barrel is positionable in an aligned condition with respect to the handle wherein a longitudinal axis of the barrel and a longitudinal axis of the handle are oriented collinearly to each other and the barrel extends away from the second end of the handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
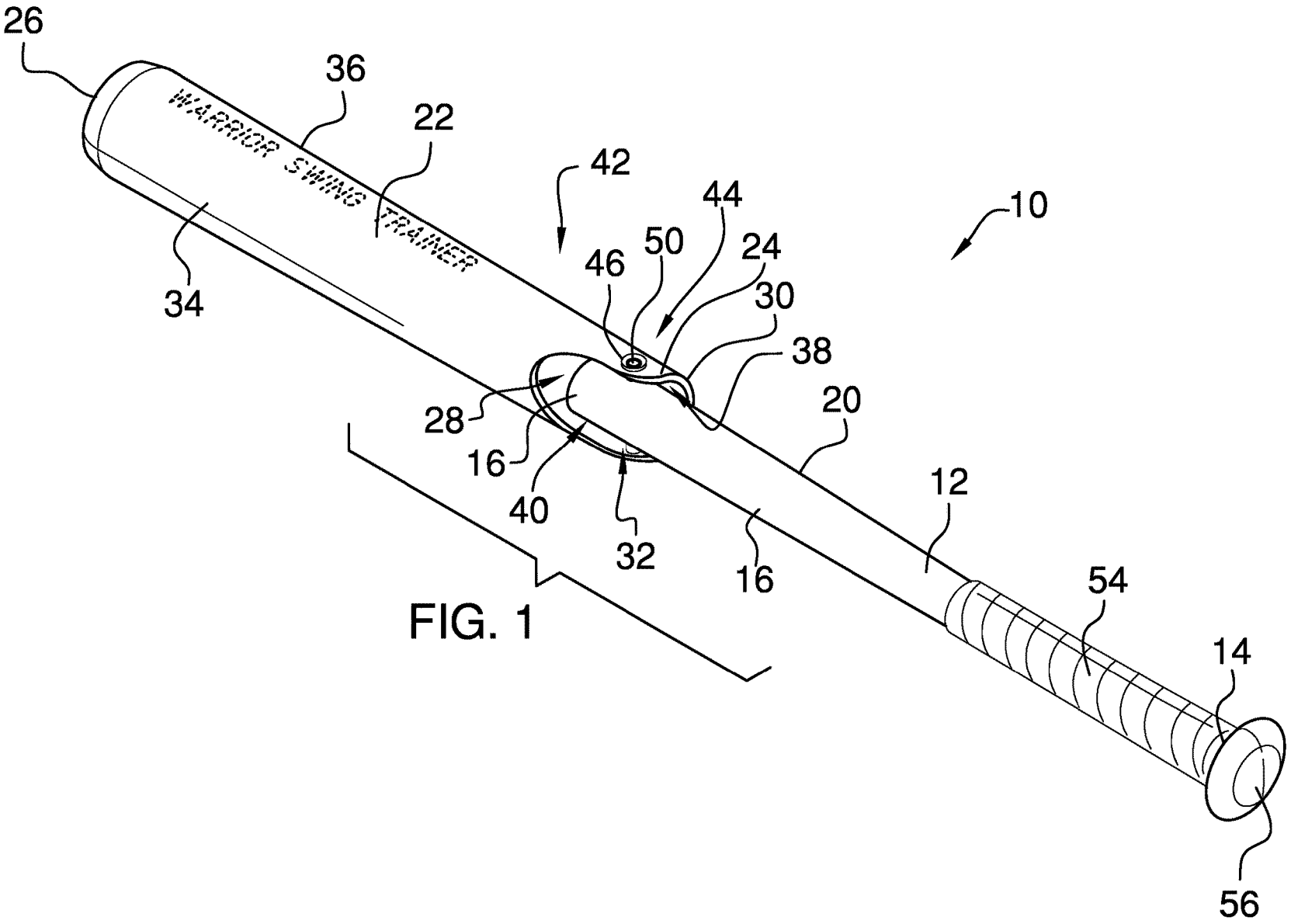
FIG. 1 is a perspective view of a training bat apparatus according to an embodiment of the disclosure.
Figure 2:
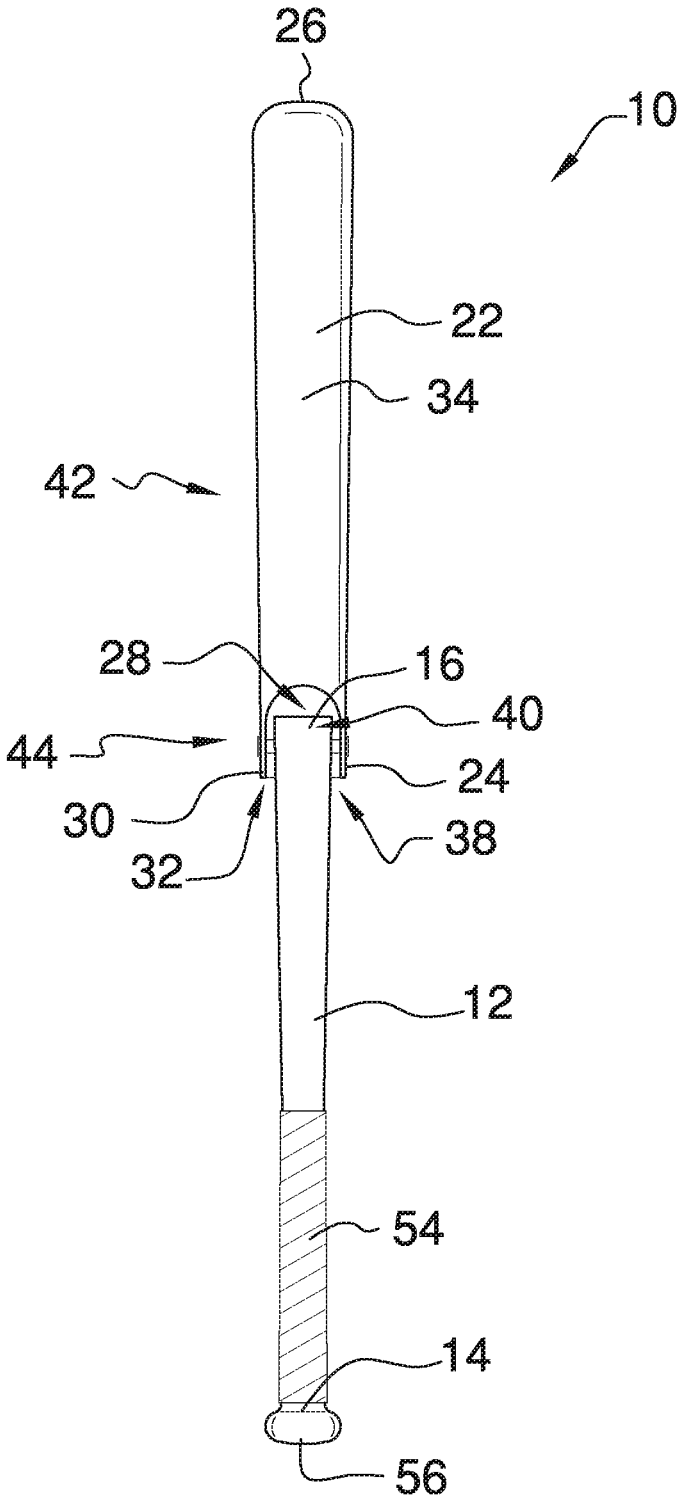
FIG. 2 is a front view of an embodiment of the disclosure.
Figure 3:
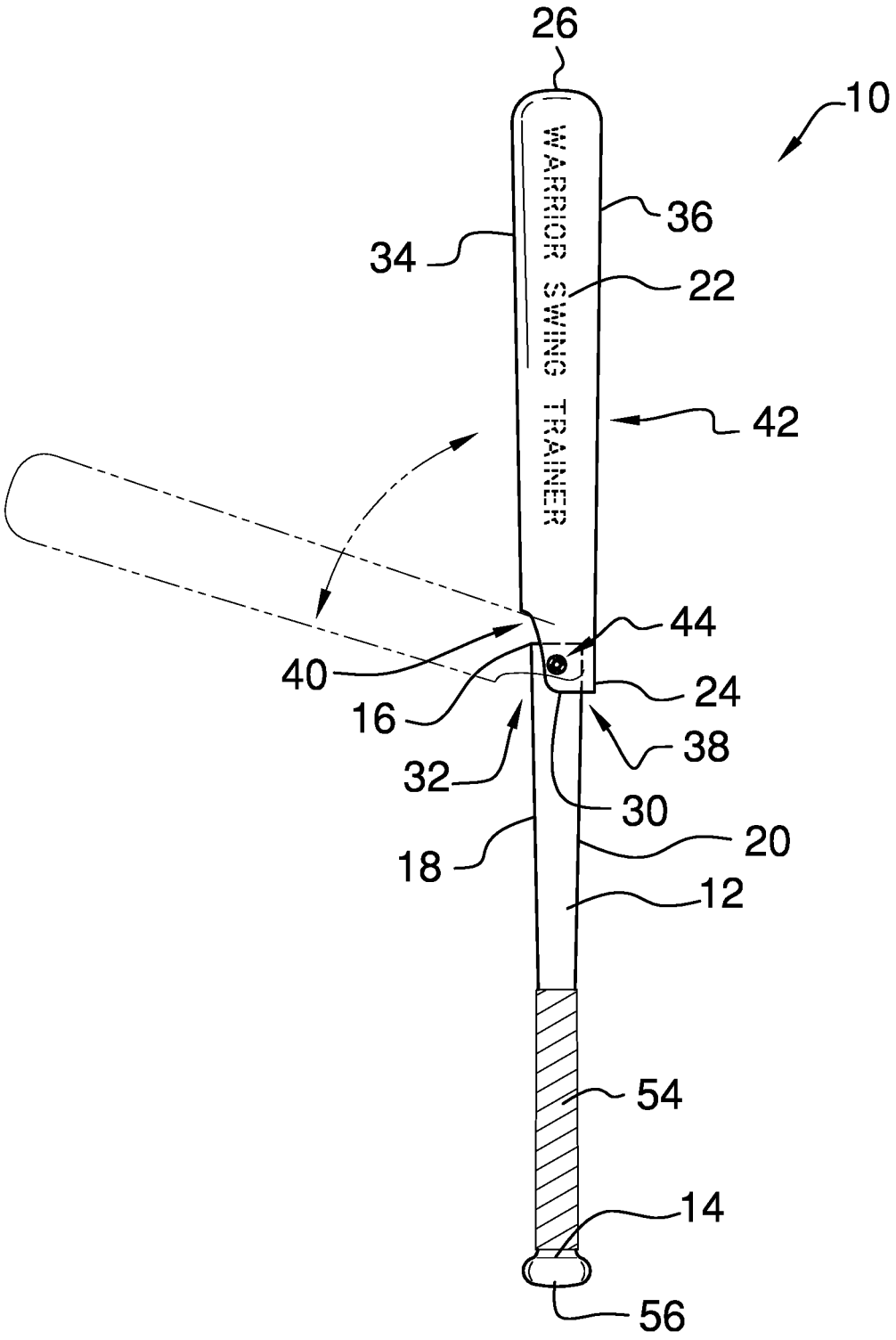
FIG. 3 is a side view of an embodiment of the disclosure.
Figure 4:
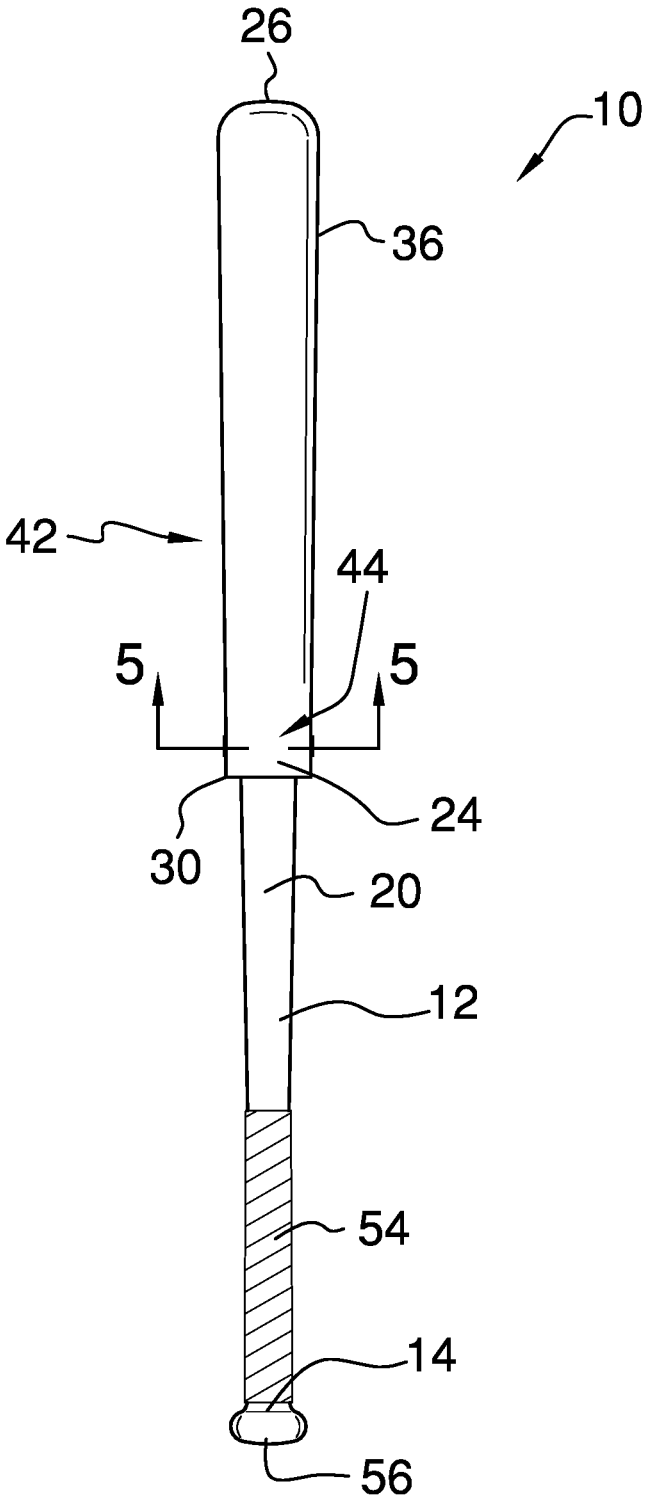
FIG. 4 is a back view of an embodiment of the disclosure.
Figure 5:
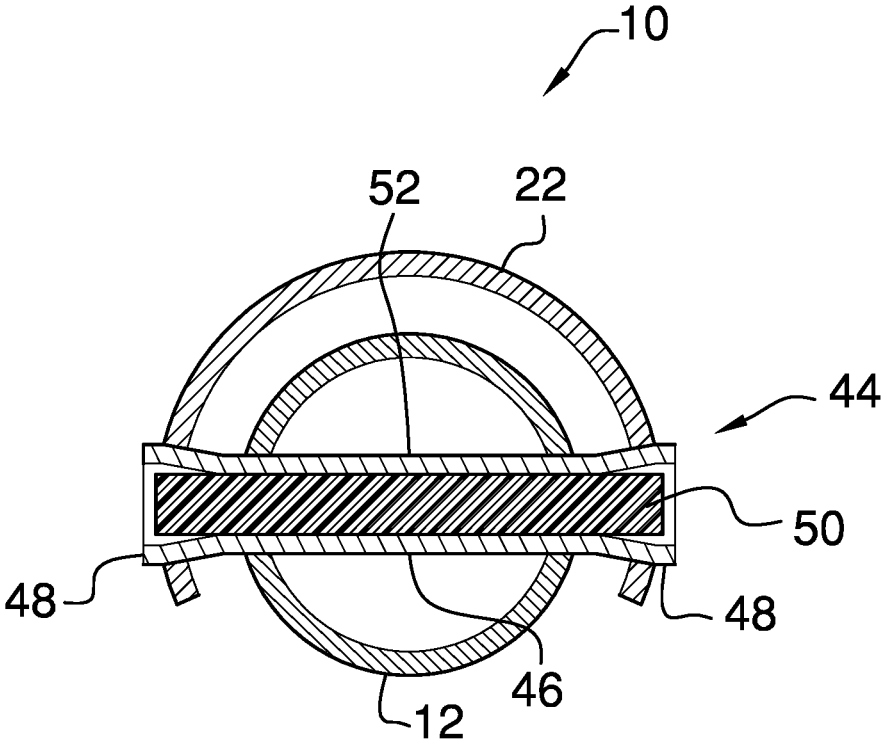
FIG. 5 is a cross-section view of an embodiment of the disclosure taken from Arrows 5-5 in FIG. 4.
Figure 6:
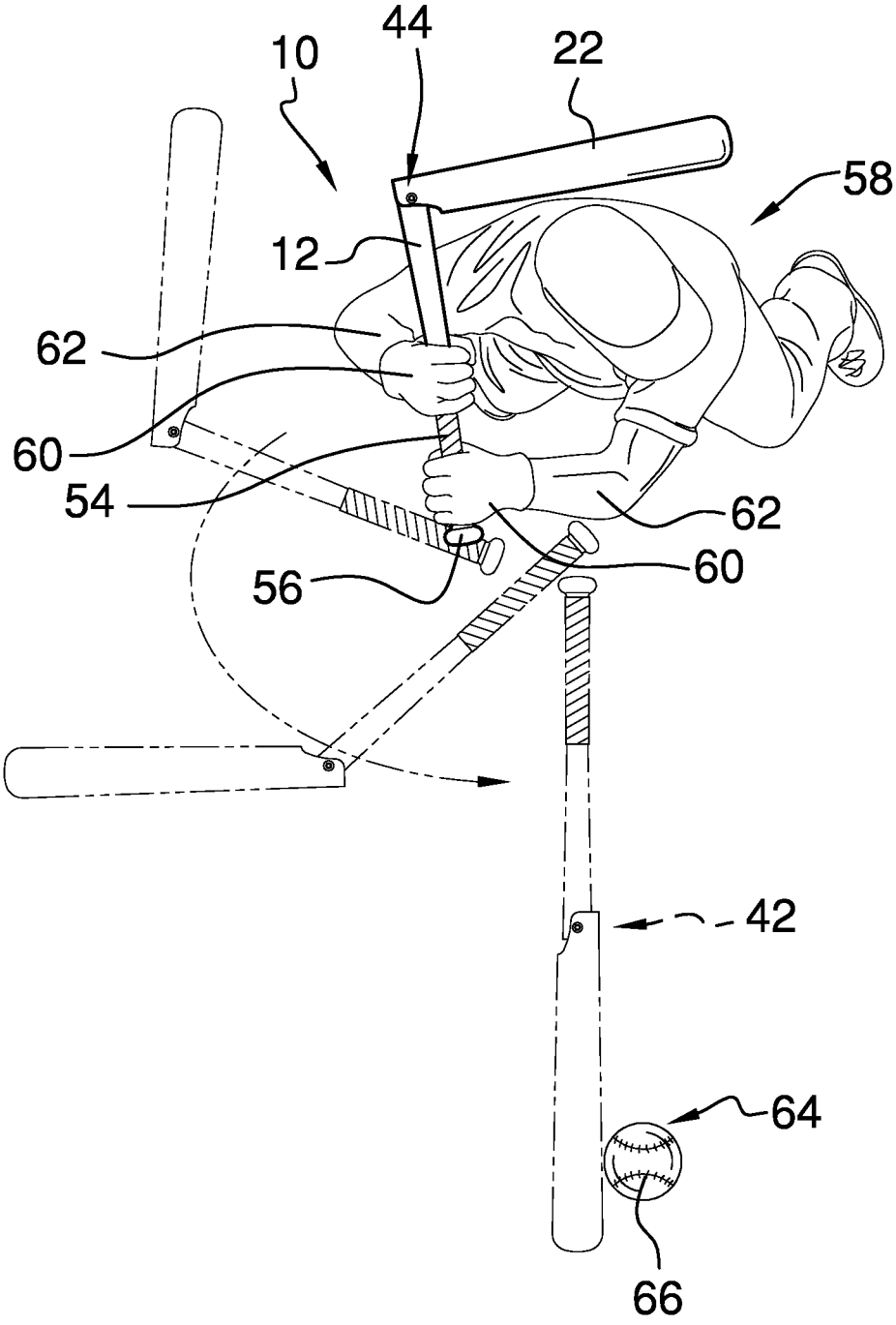
FIG. 6 is a top in-use view of an embodiment of the disclosure.

With reference now to the drawings, and in particular to FIGS. 1 through 6 thereof, a new training bat apparatus embodying the principles and concepts of an embodiment of the disclosure and generally designated by the reference numeral 10 will be described.

As best illustrated in FIGS. 1 through 6, the training bat apparatus 10 generally comprises a handle 12 that is elongated between a first end 14 and a second end 16. The handle 12 has a first side 18 and a second side 20 which are positioned opposite each other. Each of the first side 18 and the second side 20 extend between the first end 14 and the second end 16. The handle 12 has a cylindrical shape. A barrel 22 is pivotally mounted adjacent to the second end 16 of the handle 12 and is elongated between a proximal end 24 and a distal end 26 of the barrel 22 with respect to the handle 12. The barrel 22 has a cavity 28 extending therein through the proximal end 24 and has a rim 30 defining an opening 32 to the cavity 28. The handle 12 extends through the opening 32 into the cavity 28. The barrel 22 is pivotable around a pivot axis extending through and perpendicularly to each of the barrel 22 and the handle 12. The barrel 22 is positionable in an aligned condition 42 with respect to the handle 12 wherein a longitudinal axis of the barrel 22 and a longitudinal axis of the handle 12 are oriented collinearly to each other and the barrel 22 extends away from the second end 16 of the handle 12. The barrel 22 also has a generally cylindrical shape but may taper from said distal end 26 to said second end 16.

The barrel 22 has a first surface 34 and a second surface 36 each extending between the proximal end 24 and the distal end 26. The first surface 34 of the barrel 22 is positioned adjacent to the first side 18 of the handle 12, and the second surface 36 of the barrel 22 is positioned adjacent to the second side 20 of the handle 12. The opening 32 includes an end portion 38 extending through the proximal end 24 of the barrel 22 and a lateral portion 40 extending through the first surface 34 of the barrel 22. The barrel 22 is pivotable with respect to the handle 12 at least 90.0 degrees away from the aligned condition 42 toward the first side 18 of the handle 12. The barrel 22 is pivotable with respect to the handle 12 less than 15.0 degrees away from the aligned condition 42 toward the second side 20 of the handle 12.

In some embodiments, the barrel 22 is not pivotable toward the second side 20 of the handle 12 from the aligned condition 42. Pivoting of the barrel 22 toward the second side 20 of the handle 12 from the aligned condition 42 is limited in comparison to pivoting of the barrel 22 toward the first side 18 to maintain the barrel 22 generally near the aligned condition 42 after swinging the training bat apparatus 10 during use. Pivoting the barrel 22 toward either the first side 18 or the second side 20 of the handle 12 is limited by the rim 30 so that the barrel 22 does not rotate so much that the barrel 22 impacts a user 58.

A pivot pin 44 is coupled to the handle 12 and the barrel 22. The pivot pin 44 pivotally couples the barrel 22 to the handle 12. The pivot pin 44 comprises a sleeve 46 extending through the barrel 22 and the handle 12 and a core 50 mounted in the sleeve 46. The sleeve 46 has a pair of flared ends 48 which each engage the barrel 22 such that the sleeve 46 is retained on the barrel 22 and the handle 12. The core 50 is coupled to the sleeve 46 via a force fit but may be coupled via a weldment, an adhesive, a threaded fastener, or the like.

The structure of the pivot pin 44 is to facilitate manufacturing of the training bat apparatus 10. The sleeve 46 may be constructed of a ductile material and have a wall 52 with a thickness such that the flared ends 48 may be formed after inserting the sleeve 46 through the barrel 22 and the handle 12. Then the core 50, which may have a thickness greater than the thickness of the wall 52 of the sleeve 46, may be inserted into the sleeve 46 to reinforce the sleeve 46. The core 50 may be formed of a stronger material than the ductile material of the sleeve 46. For example, the ductile material may be copper and the core 50 may comprise steel.

A grip 54 is coupled to the handle 12 adjacent to the proximal end 24 and circumferentially surrounding the handle 12. A knob 56 is coupled to the proximal end 24 of the handle 12 and protruding radially outwardly from the handle 12. The knob 56 is configured for engaging one of a pair of hands 60 of a user 58 to retain the handle 12 in the hand 60 when the handle 12 is swung by the user 58.

In use, the user 58 grasps the grip 54 of the handle 12 with the pair of hands 60 and positions the barrel 22 behind the user 58 so that the barrel 22 is pivoted away from the aligned condition 42 toward the first side 18 of the handle 12 and the first surface 34 of the barrel 22 faces the user 58. The user 58 swings the training bat apparatus 10 to hit a target 64 positioned in front of the user 58. If the user 58 uses proper swinging form, the user 58 will move both hands 60 of the pair of hands 60 as far as the hands 60 can move in ulnar deviation before striking the target 64. This action causes each hand 60 of the pair of hands 60 to lock into a fixed position with respect to an associated one of a pair of arms 62 of the user 58. Locking the pair of hands 60 in this way will also impart a decelerating force on the handle 12 such that the barrel 22 will inertially rotate with respect to the handle 12 toward the alignment condition. If the user 58 uses proper swinging form, then the barrel 22 will be positioned in the alignment condition when it strikes the target 64. The target 64 may, for example, be a baseball 66, which may be pitched or placed on a tee.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A training bat apparatus comprising:

a handle being elongated between a first end and a second end; and a barrel being pivotally mounted adjacent to the second end of the handle, the barrel being elongated between a proximal end and a distal end of the barrel with respect to the handle, the barrel having a cavity extending therein through the proximal end, the barrel having a rim defining an opening to the cavity, the handle extending through the opening into the cavity, the barrel being pivotable around a pivot axis extending through and perpendicularly to each of the barrel and the handle, the barrel being positionable in an aligned condition with respect to the handle wherein a longitudinal axis of the barrel and a longitudinal axis of the handle are oriented collinearly to each other and the barrel extends away from the second end of the handle;

wherein the handle has a first side and a second side being positioned opposite each other, each of the first side and the second side extending between the first end and the second end; and wherein the barrel has a first surface and a second surface each extending between the proximal end and the distal end, the first surface of the barrel being positioned adjacent to the first side of the handle, the second surface of the barrel being positioned adjacent to the second side of the handle, the opening including an end portion extending through the proximal end of the barrel and a lateral portion extending through the first surface of the barrel such that a portion of the second surface of the barrel extends beyond the pivot axis wherein the pivot axis is positioned between the portion of the second surface of the barrel and the lateral portion of the opening.

2. The apparatus of claim 1, wherein the handle having a cylindrical shape.

3. The apparatus of claim 1, wherein the barrel is pivotable with respect to the handle at least 90.0 degrees away from the aligned condition toward the first side of the handle.

4. The apparatus of claim 1, wherein the barrel is pivotable with respect to the handle less than 15.0 degrees away from the aligned condition toward the second side of the handle.

5. The apparatus of claim 1, further comprising a pivot pin being coupled to the handle and the barrel, the pivot pin pivotally coupling the barrel to the handle.

6. The apparatus of claim 5, wherein the pivot pin comprises:

a sleeve extending through the barrel and the handle, the sleeve having a pair of flared ends, each flared end of the pair of flared ends engaging the barrel such that the sleeve is retained on the barrel and the handle; and a core being mounted in the sleeve.

7. The apparatus of claim 6, wherein the core is coupled to the sleeve via a force fit.

8. The apparatus of claim 1, further comprising a grip being coupled to the handle adjacent to the proximal end, the grip circumferentially surrounding the handle.

9. The apparatus of claim 1, further comprising a knob being coupled to the proximal end of the handle and protruding radially outwardly from the handle, the knob being configured for engaging a hand of a user to retain the handle in the hand when the handle is swung by the user.

10. A training bat apparatus comprising:

a handle being elongated between a first end and a second end, the handle having a first side and a second side being positioned opposite each other, each of the first side and the second side extending between the first end and the second end, the handle having a cylindrical shape;

a barrel being pivotally mounted adjacent to the second end of the handle, the barrel being elongated between a proximal end and a distal end of the barrel with respect to the handle, the barrel having a cavity extending therein through the proximal end, the barrel having a rim defining an opening to the cavity, the handle extending through the opening into the cavity, the barrel being pivotable around a pivot axis extending through and perpendicularly to each of the barrel and the handle, the barrel being positionable in an aligned condition with respect to the handle wherein a longitudinal axis of the barrel and a longitudinal axis of the handle are oriented collinearly to each other and the barrel extends away from the second end of the handle, the barrel having a first surface and a second surface each extending between the proximal end and the distal end, the first surface of the barrel being positioned adjacent to the first side of the handle, the second surface of the barrel being positioned adjacent to the second side of the handle, the opening including an end portion extending through the proximal end of the barrel and a lateral portion extending through the first surface of the barrel such that a portion of the second surface of the barrel extends beyond the pivot axis wherein the pivot axis is positioned between the portion of the second surface of the barrel and the lateral portion of the opening, the barrel being pivotable with respect to the handle at least 90.0 degrees away from the aligned condition toward the first side of the handle, the barrel being pivotable with respect to the handle less than 15.0 degrees away from the aligned condition toward the second side of the handle;

a pivot pin being coupled to the handle and the barrel, the pivot pin pivotally coupling the barrel to the handle, the pivot pin comprising:

a sleeve extending through the barrel and the handle, the sleeve having a pair of flared ends, each flared end of the pair of flared ends engaging the barrel such that the sleeve is retained on the barrel and the handle; and a core being mounted in the sleeve, the core being coupled to the sleeve via a force fit;

a grip being coupled to the handle adjacent to the proximal end, the grip circumferentially surrounding the handle; and a knob being coupled to the proximal end of the handle and protruding radially outwardly from the handle, the knob being configured for engaging a hand of a user to retain the handle in the hand when the handle is swung by the user.

* * * * *